US005753892A

United States Patent [19]

Gross et al.

[11] Patent Number: 5,753,892

[45] Date of Patent: May 19, 1998

[54] ELECTRIC RADIANT HEATER AND METHOD FOR ITS MANUFACTURE

[75] Inventors: Martin Gross, Kaempfelbach; Eugen Wilde, Knittlingen-Freudenstein; Hans Mohr, Sulzfeld; Werner Renz, Sternenfels; Franz Bogdanski, Oberderdingen, all of Germany

[73] Assignee: E.G.O. Elektro-Gerate Blanc und Fischer GmbH & Co. KG, Germany

[21] Appl. No.: 604,413

[22] Filed: Feb. 21, 1996

[30] Foreign Application Priority Data

Feb. 25, 1995 [DE] Germany ..... 195 06 685.5

[51] Int. Cl.[6] ..... H05B 3/02; H05B 3/06

[52] U.S. Cl. ..... 219/468; 219/467; 219/542

[58] Field of Search ..... 219/463, 465, 219/467, 468, 542, 544; 338/280, 281, 283, 284

[56] References Cited

U.S. PATENT DOCUMENTS

| | | | |
|---|---|---|---|
| 600,057 | 3/1898 | Ball | 219/542 |
| 3,567,906 | 3/1971 | Hurko | 219/467 |
| 3,984,615 | 10/1976 | Beck | 219/542 |
| 4,161,648 | 7/1979 | Goessler | 219/464 |
| 4,207,672 | 6/1980 | Wohlert . | |
| 4,292,504 | 9/1981 | Gebarowski et al. | 219/542 |
| 4,471,214 | 9/1984 | Gossler et al. | 219/464 |
| 5,181,312 | 1/1993 | Gross . | |
| 5,196,687 | 3/1993 | Sugino et al. . | |
| 5,453,597 | 9/1995 | McWilliams | 219/467 |
| 5,477,031 | 12/1995 | McWilliams | 219/467 |
| 5,477,605 | 12/1995 | McWilliams et al. . | |
| 5,498,853 | 3/1996 | Gross et al. . | |

FOREIGN PATENT DOCUMENTS

| | | |
|---|---|---|
| 612198 | 8/1994 | European Pat. Off. . |
| 612199 | 8/1994 | European Pat. Off. . |
| 625865 | 11/1994 | European Pat. Off. . |
| 317753 | 12/1919 | Germany . |
| 2551137 | 5/1977 | Germany . |
| 3812490 | 11/1989 | Germany . |
| 9313219 | 12/1993 | Germany . |
| 4229375 | 3/1994 | Germany . |
| 2278261 | 11/1994 | United Kingdom . |

*Primary Examiner*—Teresa J. Walberg
*Assistant Examiner*—Sam Paik
*Attorney, Agent, or Firm*—Quarles & Brady

[57] ABSTRACT

For producing an electric radiant heater a thin heating resistance material strip is placed upright on an insulator. It has foot portions, which are embedded in the heating conductor material. The foot portions are only connected by thin connecting webs to the heating area and are differently shaped and/or oriented to the corrugated heating conductor strip.

8 Claims, 2 Drawing Sheets

ELECTRIC RADIANT HEATER AND METHOD FOR ITS MANUFACTURE

BACKGROUND OF THE INVENTION

The invention relates to an electric radiant heater with an insulator and at least one heating conductor fixed on its surface by embedding in the form of an upright strip, which forms with its width portion located over the surface a substantially uninterrupted heating area with a corrugation and with its width portion embedded in the insulator an at least partly interrupted embedding area with individual foot portions.

DE-U-93 13 219 discloses such a radiant heater. The very thin strip construction and its relatively-weak coupling to the insulator makes it possible, despite surface temperatures in an area of the heater admissible for the strip life, to very rapidly glow (approximately 3 seconds).

In the utility model the foot portions are in the form of e.g. trapezoidal projections, which as a function of their length are more or less heating-active. The smaller their dimensions in the strip longitudinal direction compared with their height or the height of the heating area, the lower the heat fraction produced therein.

In order to keep this fraction low, the utility model proposes perforations or T-shaped indentations, which reduce the heating activity of the foot portions.

In the utility model embedding preferably takes place by pressing the foot portions into a shaped body made from microporous insulating material. It is advantageous for this purpose to curve the foot portions corresponding to the corrugation, in order to give them a greater stiffness for pressing in. They are then shaped like a spade with a curved shovel.

However, it is also possible to embed the heating conductor strip in that the insulating material body is sealed round the foot portions. Here again the spade shape has an advantageous stiffening action, in that it increases the resistance of the strip to tilting over and increases the retaining force in the lateral and longitudinal directions.

OBJECTS OF THE INVENTION

The object of the invention is to provide an electric radiant heater, which further improves the aforementioned prior art and in particular improves the fixing of the heating conductor strip in the insulator with a reduced heating activity of the foot portions.

SUMMARY OF THE INVENTION

Due to the fact that the shape and orientation of the foot portions diverge from the corrugation of the heating area the following advantages are obtained. If the foot portions are parallel to the strip and are arranged very tightly to improve their anchoring, they form a through channel in the insulator. As the individual heating conductors run in parallel with a relatively small spacing in the heater, then the intermediate area between two heating conductors is "perforated free" and tends to crumble out. However, if the foot portions have a different orientation, this largely through perforation is avoided.

The foot portions can be substantially flat. They then diverge from the corrugated shape of the heating area. They can also be deliberately turned with respect to the heating area.

Advantageously the foot portions are connected to the heating area by connecting portions, whose dimensions along the strip are much smaller than the dimensions of the foot portions in this direction. The connecting portions can be notches, which are separated either by a relatively wide punching or by very narrow notches from the heating area.

In the first case the fixing by the engaging of the insulating material over the foot portions is particularly good, whereas in the latter case overall height and strip material are saved. Through the divergence of the foot portions from the corrugation of the heating area it is also ensured that with relatively narrow notches there is no contacting outside the contacting portions between the heating area and the foot portion, which would once again increase the heating activity of the foot portions. This is undesired, because it leads to a power reduction in these portions and can lengthen the glow time.

The invention also proposes a method for the manufacture of the heating conductor for the aforementioned electric radiant heater. For this purpose on a heating conductor material strip foot portions can be divided off by notches and/or punchings and then the strip is corrugated in the heating conductor area. Due to the fact that the foot portions are not corrugated, they remain substantially flat in the orientation assumed by their connecting portion with respect to the heating conductor strip. If there is no synchronization between the corrugation and the foot portion spacing, they project relatively irregularly and substantially tangentially from the strip, so that they are ideally fixed in the insulating material.

These and further features can be gathered from the claims, the description and drawings and the individual features, both singly and in the form of subcombinations, can be implemented in an embodiment of the invention and in other fields and can represent advantageous, independently protectable constructions for which protection is hereby claimed.

SHORT DESCRIPTION OF THE DRAWINGS

Embodiments of the invention are described hereinafter relative to the drawings, wherein show:

FIG. 1 A perspective detail view of an electric radiant heater.

FIGS. 2 & 3 Greatly enlarged detail views of an embedded heating conductor.

FIG. 4 A plan view of a heating conductor prior to its embedding.

DETAILED DESCRIPTION OF A PREFERRED EMBODIMENT

Figure 1:
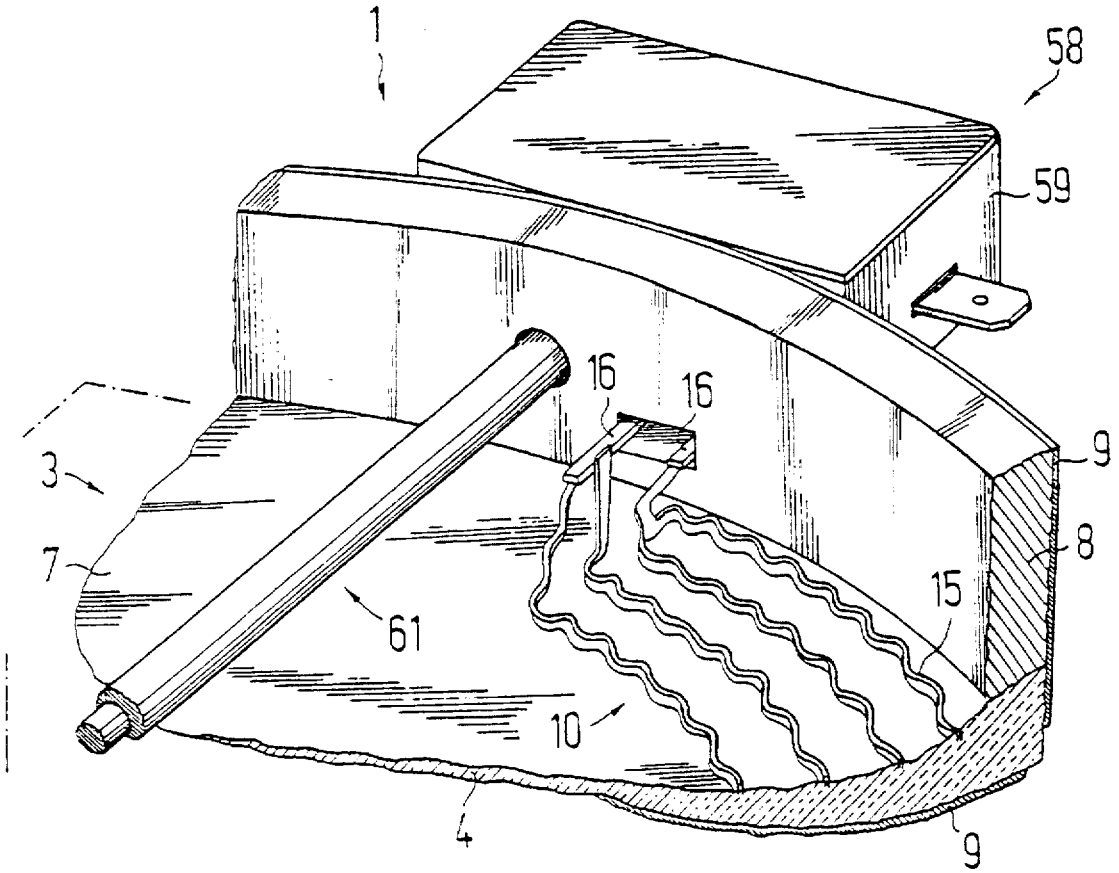

FIG. 1 shows a radiant heater provided for fitting below a cooking surface, e.g. a glass ceramic plate. It has a sheet metal support tray 9, which has a shallow dish shape. In it is located insulation 3, which comprises a substantially flat, disk-shaped insulator 4 and an insulating rim 8, which externally passes round and rests thereon. The insulator 4 e.g. comprises a tablet-shaped member made from compressed, previously pourable insulating material, e.g. pyrogenic or fumed silicon dioxide, which has optimum thermal insulating characteristics with a high thermal stability. Through the incorporation of mineral fibres, binders and other, optionally radiation characteristic-influencing constituents, the insulating material can be adapted to conditions.

On the surface 7 of the insulator 4 there are heating conductors 10, in the form of upright, corrugated strips made from conventional electrical resistance material. These strips are very thin, their thickness being between 0.02 and 0.1 mm, preferably between 0.03 and 0.08 mm.

The resistance values and the ratio between the heating conductor mass and the surface are such that a rapidly glowing heater is obtained, which after a few, e.g. 3 seconds has reached the glow temperature. However, as a result of the good radiation conditions of the strip which is wide compared with its thickness, it is ensured that the surface temperatures in the stationary state do not exceed any limit which would reduce the service life.

The temperature sensor 61 of a thermal cutout 58 projects in spaced manner over the surface 7 of the insulator 4, which is uniformly covered in spiral or loop paths with heating conductors 10 (only partly shown).

Figure 2:
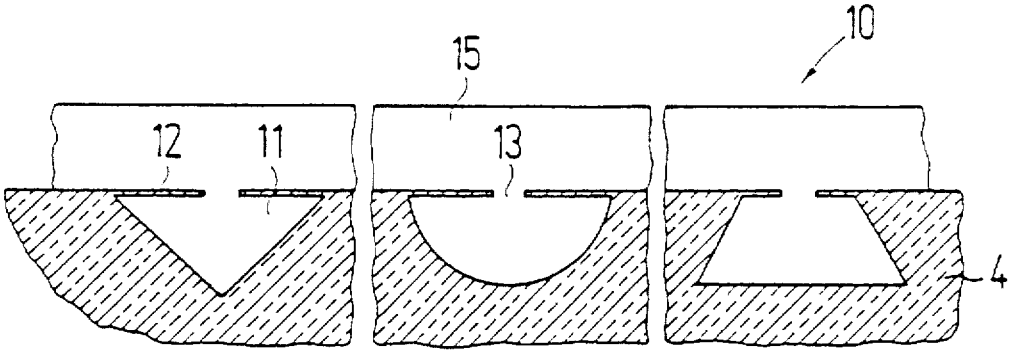
Figure 3:
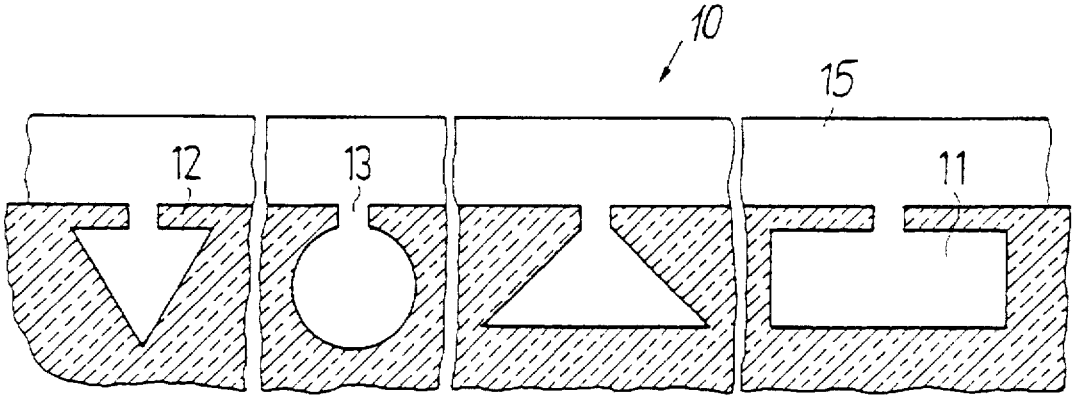

As can be gathered from FIGS. 2 and 3, the heating conductors 10 are partly embedded in the insulator 4, namely with foot portions 11, which are clearly defined with respect to the heating area 15 constructed as a through, corrugated strip.

The heating conductors are connected by means of connections 16, which project through the insulating rim 8, to the thermal cutout 58, which simultaneously serves as a connecting piece.

The corrugations, which can be very intense and have a limited pitch, can reach corrugation factors (ratio of the stretched length to the corrugated strip length) of up to 4.

As can be seen in FIGS. 2 and 3, the foot portions 11 can have the most varied shapes, i.e. triangular, a downwardly directed arrow shape, semicircular, trapezoidal, circular, triangular with a lower longer side, rectangular, etc. They are separated from the heating area 15 by notches 12, which are relatively narrow in FIG. 2 and relatively wide in FIG. 3. The narrower notches can be formed by notching and the wider notches by punching out.

It is common to both embodiments that the foot portions 11 are connected to the heating area 15 by connecting portions 13, which in the embodiment in each case interrupt in the centre of the foot portions the notches 12 formed from both sides and in FIG. 3 are constructed as central webs. However, they could also be located on one side, so that under certain conditions the hereinafter described retaining action would be further improved.

Figure 4:
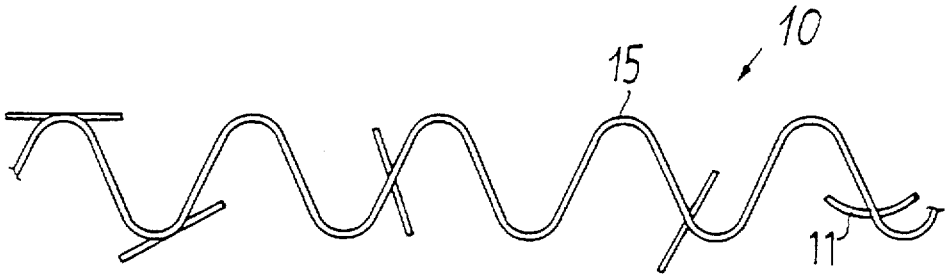

As shown in FIG. 4, the foot portions are substantially flat, i.e. their profile does not follow the strip corrugation or are more or less curved than the latter. As is apparent from above the strip in FIG. 4, they have a different configuration from the strip configuration which appears there as a uniform corrugation. They could also have the same wave shape as the heating area 15, but with a different orientation thereto. This is made possible by the relatively narrow connecting portions 13, which do not allow the corrugation to act in the foot portion if the strip is so corrugated that e.g. only the heating area 15 passes through the corrugating tools, e.g. two cooperating gear wheels, whereas the foot portions remain uninfluenced. This leads to the orientation, such as occurs in FIG. 4 with the foot portions to the left, i.e. the foot portions run substantially tangentially to the strip. The two central portions are deflected with respect to the strip extension, which can take place through different influences. However, they are flat, whereas the aforementioned foot portion construction 11 to the far right although having the same curvature as the strip, it is differently deflected.

In the embedded state the following advantages occur. The foot portions are thermally and electrically connected to the heating area 15 only by the narrow connecting portion 13. Thus, there is essentially no flow through the foot portion which is heating-passive and is consequently not originally heated.

There is also little line heat through the connecting portion 13. The resulting thermal passivity of the foot portions 11 makes it possible to give them a virtually random size and ideally adapt to the embedding conditions, without this influencing the heating characteristics. The fact that the foot portions are differently shaped or oriented to the heating area 15 running parallel thereto also has several effects. In the vicinity of the notches 12 the foot portions 11 can at least partly be covered by the embedding substance and therefore form direct anchors in the insulating material, whereas with the same orientation with respect to the heating area material would scarcely penetrate the notches in order to bring about an anchoring. As a result of the completely irregular and random arrangement and orientation of the foot portions shown in FIG. 4, it is ensured that through the narrow standing foot portions no channel cutting through the insulation is formed and which could lead to crumbling between two adjacent heating conductor paths (cf. FIG. 1).

In the case of relatively narrow notches 12 it is ensured that no electric contact bridges form, which would then incorporate the foot portions into the current flow and could produce undesired heating activity on the part of the foot portions.

For producing the radiant heater, accompanied by the application of the heating conductors 10, use can be made of a method in which the insulator 4 is still relatively soft during the application of said heating conductors 10. This is also dependent on the nature of the foot portions and the thickness of the heating conductor material, as well as the nature of the insulating material for the insulator. Embedding the previously loose insulating material round the foot portions, in that the heating conductors are applied to a male mould in such a way that the heating area 15 is located in slots, whereas the foot portions project. The heating conductor material is then introduced into a cylindrical female mould and compressed with the male mould, the foot portions 11 also being shaped. It would also be possible to use a relatively soft rough pressed block, in which the foot portions are pressed and then subsequent compression takes place.

We claim:

1. An electric radiant heater comprising:

an insulator having a surface;

at least one heating conductor in the form of an upright strip and foot portions, said strip having lateral surfaces extending substantially perpendicular to the surface of the insulator and defining a strip periphery; said strip having a thickness substantially between 0.02 mm and 0.1 mm; said strip being corrugated longitudinally; said strip being fixed to the insulator surface by partly embedding the strip in the insulator;

said strip including a heating area located above the insulator surface and an embedded area connected to the foot portions embedded in the insulator;

said foot portions each extending substantially perpendicular to said insulator surface and extending laterally beyond the periphery of the strip.

2. Radiant heater according to claim 1, wherein the foot portions are substantially flat.

3. Radiant heater according to claim 1, wherein the foot portions are connected to the heating area by connection portions of the strip, said connecting portions having lengths transverse to their thickness, said foot portions having lengths transverse to their thickness, said connecting portion lengths adjacent said heating area being substantially smaller than the lengths of the foot portions.

4. Radiant heater according to claim 3, wherein the foot portions, with the exception of the connecting portions, are separated from the heating area by notches.

5. Radiant heater according to claim 4, wherein the notches have a limited width of less than 1 mm.

6. Radiant heater according to claim 1, wherein the heating conductor strip is only corrugated in the heating area.

7. The electric radiant heater according to claim 1, wherein the heating area of the strip is a band having a uniform cross section along its length and the embedded area of the strip extends from the heating area of the strip and has gaps along its length.

8. Method for manufacturing a heating conductor for an electric radiant heater, wherein, on a heating conductor material strip, foot portions are divided off from a heating area by notches and then the strip is corrugated in the heating area without corrugating the foot portions.

* * * * *